106-84 AU 113 EX
9/11/79 XR 4,167,418

United States Patent [19]
Svirsky et al.
[11] 4,167,418
[45] Sep. 11, 1979

[54] PROTECTIVE COATING FOR METAL INGOT MOLDS AND CORES

[76] Inventors: Lazar D. Svirsky, ulitsa Pushkinskaya, 74, kv. 84; Valentina P. Zhurzhenko, ulitsa Artema, 26, kv. 1; Tamara S. Bondarenko, ulitsa Galana, 3, kv. 4; Antonina K. Savenkova, ulitsa Gvardeitsev Shironintsev, 38, kv. 143; Valery M. Kazakevich, ulitsa Pushkinskaya, 49a, kv. 14, all of Kharkov; Yakov A. Shneerov, ulitsa Dzerzhinskogo 8, kv. 21, Dnepropetrovsk; Evgeny M. Ogryzkin, prospekt K. Marxa, 10, kv. 37, Dnepropetrovsk; Anatoly A. Geizenblaz, ulitsa Dzerzhinskogo, 15, kv. 1, Dnepropetrovsk; Gennady S. Kolganov, ulitsa Revoljutsionnaya, 31, kv. 26, Krivoi Rog Dnepropetrovskoi oblasti; Vladislav V. Burshtein, ulitsa Bensitskaya, 8, kv. 3, Krivoi Rog Dnepropetrovskoi oblasti; Vladimir F. Sivakov, ulitsa Postysheva, 5, kv. 14, Krivoi Rog Dnepropetrovskoi oblasti; Evgeny A. Bogdanovich, ulitsa Zernovaya, 1a, kv. 16, Kharkov; Vitaly M. Burdonos, Naberezhnaya, 16, kv. 52, Dnepropetrovsk; Viktor N. Andrjuschenko, ulitsa Postysheva, 9, kv. 111, Krivoi Rog Dnepropetrovskoi oblasti; Oleg A. Bushinsky, prospekt Mira, 17, kv. 157, Krivoi Rog Dnepropetrovskoi oblasti; Grigory A. Makarov, ulitsa Kosiora, 75, kv. 29, Krivoi Rog Dnepropetrovskoi oblasti; Oleg V. Filonov, ulitsa Kosiora, 12, kv. 8, Krivoi Rog Dnepropetrovskoi oblasti; Vladimir I. Tupitsa, ulitsa Revoljutsionnaya, 6, kv. 44, Krivoi Rog Dnepropetrovskoi oblasti; Valery I. Nikitenko, prospekt Metallurgov, 14, kv. 26, Krivoi Rog Dnepropetrovskoi oblasti; Nikolai M. Omes, ulitsa Tynka, 32, kv. 48, Krivoi Rog Dnepropetrovskoi oblasti, all of U.S.S.R.

[21] Appl. No.: 836,490

[22] Filed: Sep. 26, 1977

[51] Int. Cl.[2] ..... B28B 7/36
[52] U.S. Cl. ..... 106/38.28; 106/38.3; 106/38.9; 106/56; 106/68; 106/71; 106/84; 164/33; 427/135
[58] Field of Search ..... 106/38.28, 38.3, 38.35, 106/38.9, 56, 68, 71, 84; 164/33; 427/135

[56] References Cited

U.S. PATENT DOCUMENTS

| | | | |
|---|---|---|---|
| 3,637,412 | 1/1972 | Felice et al. | 106/38.28 |
| 3,656,977 | 4/1972 | Dreyling et al. | 106/84 |
| 3,810,768 | 5/1974 | Parsons et al. | 106/56 |
| 3,842,760 | 10/1974 | Parsons et al. | 106/56 |

*Primary Examiner*—Lorenzo B. Hayes
*Attorney, Agent, or Firm*—Lackenbach, Lilling & Siegel

[57] ABSTRACT

A protective coating includes fire clay, graphite, water glass, water and alumina-containing material, the ingredients being present in an amount of up to a half the weight of the total mixture. Used as the alumina-containing material are such substances as commercial alumina, abrasive slurry, catalyst wastes from the production of synthetic rubber. The protective coating may also include in its composition a boron-containing material in an amount of from 0 to 10 percent by weight of the total weight of the composition, such as datolite and danburite concentrate, ascharite, boric acid, colemanite, pandermite, borocalcite, boronatrocalcite, as well as soda ash in an amount of from 0 to 5 percent by weight.

5 Claims, No Drawings

PROTECTIVE COATING FOR METAL INGOT MOLDS AND CORES

The present invention relates to the protection of metals against high-temperature corrosion, and more particularly to the metallurgy of high-heat-duty protective coatings.

The problem of prolonging the service life of various types of casting molds is assuming an ever greater importance today because of the rapidly growing production of converter metal, increasing weight of ingots, application of high-speed casting method and that of top casting. From the foregoing it follows that casting molds are subject to far more severe operating conditions which render them prematurely inoperative.

The aforesaid problem, therefore, has brought to life new technological improvements or trends in the technique of protecting metals, including treatment of cast iron with various modifying agents, microalloying of interior surfaces of ingot molds, as well as application of protective dyes.

The last trend referred to above appears to have considerable promise, offering high efficiency at reasonably low cost.

BACKGROUND OF THE INVENTION

Presently used organic greases do not comply with the requirements for the protection of ingot molds and fail to assure high-heat-duty performance thereof due to low resistivity of such greases to high temperatures. There are also known to be in practice protective coatings of non-organic origin, such as silicate coatings, which are characterized by either their complex chemical composition or intricate coating technique which necessitates pre-heating of casting molds to relatively high temperatures on the order of 1200° to 1300° C.

For example, there is known in the art a silicate coating (cf. U.S.S.R. Inventor's Certificate No 211,754), comprising a vitreous component of the following composition, in percent by weight of the total weight of the coating: BaO, 12.5; $SiO_2$, 15; $B_2O_3$, 12.5; $Na_2O$, 37.5; $Al_2O_3$, 22.5; and commercial alumina.

The ratio of vitreous component to alumina is 30 to 20% and 70 to 80%, respectively. Likewise, added to the composition of said coating in excess of 100% is graphite in an amount of 5 to 7%, fire clay in an amount of 4 to 8%, and alcohol-sulphite lye in an amount of 8 to 10%.

The coating of the Inventor's Certificate referred to above suffers from the following disadvantages:

- the presence in its composition of vitreous component, the production of which requires installation of additional equipment (melting furnace, grinding, sizing and screening apparatus);
- multicomponent structure which complicates the production process;
- low mechanical strength and thermal stability because of insufficient reactivity of the vitreous component to commercial alumina;
- difficulties in ensuring production effectiveness, resulting from inability to easily set up the process of vitreous component fusion under conditions of metallurgical and machine-building plants;
- the presence of BaO in the composition of the vitreous component makes the coating toxic, which impairs health conditions at work.

In addition, the presence in the coating composition of critical and expensive materials such as $B_2O_3$, alumina, and BaO, increases the coating production cost, which renders impossible its wide application.

There are also known protective coatings disclosed in U.S. Pat. No 3,509,936, U.S. Pat. No 3,396,935, Belgium Pat. No 661,520, Japan Pat. No 48-7566, which, judging by their specifications, should suffer from a common disadvantage, it being insufficient operating durability due to the presence of a crystalline component, expressed as $SiO_2$ and $ZrO_2$, which undergoes polymorphic transformations under the action of molten metal temperatures, followed by changes in their volume and low strength of adhesion to the mold surface due to the presence of colloidal silica sol in their composition.

Moreover, the presence of colloidal silica sol in the composition of the protective coatings of the patents referred to above complicates the process of their production and requires additional equipment. It should also be noted that the aforesaid sol is a rather specific material.

It is an object of the present invention to provide a protective coating for ingot molds, casting molds and cores, which exhibits higher mechanical strength after solidification and sintering, as compared to the prior-art protective coatings.

Another object of the invention is to provide a protective coating which shows improved adhesion properties enabling the coating, adhesively applied to the mold working surface, to effectively withstand the washing-off force created by the flow of molten metal.

Yet another object of the invention is to provide a protective refractory coating which possesses substantial heat-insulating capacity making it possible to reduce thermal shock both on the surface and within the body of a mold, and thereby to limit the intrusion of molten metal to the mold working surface, as well as increase operating durability of casting molds.

Still another object of the present invention is to provide a protective coating which exhibits higher thermal stability, higher softening point, said coating being practically non-toxic.

It is, therefore, an object of the invention to provide a protective coating which will make it possible to enhance labor productivity in the shops where mold composition for casting is prepared, and increase production capacity of such shops by introducing simpler operating techniques for preparing a refractory mass through elimination of such operations as cleaning and washing of ingot molds, as well as by prolonging the service life of the refractory mass, enabling several casting cycles for example, five or six casting cycles to be carried out with a single application thereof to the mold surface.

Still another object of the invention is to provide a refractory coating with high physical-and-mechanical characteristics which render it suitable for protecting bottom molds exposed to high mechanical and thermal shocks while molten metal is poured thereinto.

Yet another object of the invention is to provide a refractory coating which will allow a reduction in the number of surface defects when casting ingots and increase the yield of quality metal.

Still another object of the invention is to provide a refractory coating which, if applied to the mold working surface in a layer with a thickness thereof being controlled over the height of a casting mold, will ensure directed crystallization of metal and reduce defects in the ingot macrostructure.

It is also an object of the invention to provide a protective coating which does not include in its composition scarce, critical and expensive components, and which exhibits high operating efficiency, and is easy and inexpensive to prepare.

It is likewise an object of the invention to provide a protective coating of such a composition which will enable diffusion processes to take place at a casting temperature of molten metal, and substitution or iron atoms in the surface layer of a casting mold by the atoms of aluminum and boron, which substantially enhances durability of casting molds.

These and other objects of the invention are accomplished by the provision of a refractory coating for the protection of ingot molds, casting molds and cores, which includes fire clay, graphite, water glass, water and a glass-ceramic component, the latter being alumina-containing material in an amount of not more than a half the weight of the total mixture and containing not less than 70 wt.% of $Al_2O_3$ (according to its chemical composition), the latter being in alpha form. The above-cited composition makes it possible to obtain a coating of high mechanical strength and with improved adhesion properties after its solidification and sintering, said coating being chemically inert to the molten metal and slag-resistant.

In accordance with an embodiment of the invention, there is proposed a protective coating for ingot molds, casting molds and cores, which includes the following components: alumina-containing material with not less than 70 wt.% (according to its chemical composition) of $Al_2O_3$ being present therein in alpha form; boron-containing material wherein $B_2O_3$ is present in an amount of not less than 15 wt.% (according to its chemical composition); soda ash; fire clay; graphite; water glass and water; said ingredients being present in the following amounts:

| | percent by weight of the total coating |
|---|---|
| Alumina-containing material with not less than 70 wt. % of $Al_2O_3$ /according to its chemical composition/ being present therein in alpha form | 20 to 48 |
| Boron-containing material with $B_2O_3$ being present therein in an amount of not less than 15 wt. % /according to its chemical composition/ | 0 to 10 |
| Soda ash | 0 to 5 |
| Fire clay | 2 to 5 |
| Graphite | 1 to 4 |
| Water glass | 2 to 5 |
| Water, | the balance. |

The herein proposed composition makes it possible to obtain a heat-resistant coating having higher softening temperature, and non-toxic.

In accordance with another embodiment of the invention a protective coating includes commercial-grade alumina as the alumina-containing material, and datolite concentrate as the boron-containing material, these and other ingredients contained in the coating composition being present in the following amounts:

| | Percent by weight of the total coating |
|---|---|
| Commercial-grade alumina | 35 to 40 |
| Datolite concentrate | 5 to 7 |
| Soda ash | 2 to 4 |

-continued

| | Percent by weight of the total coating |
|---|---|
| Graphite | 2.5 to 4 |
| Fire clay | 2 to 4 |
| Water glass | 2 to 5 |
| Water, | the balance. |

Such a composition enables the obtaining of a protective coating which possesses substantial heat-insulting capacity, and enabling diffusion processes to take place at a casting temperature of molten metal, with substitution of the atoms of iron in the surface layer of a casting mold by the atoms of aluminum and boron, which substantially enhances durability of casting molds.

In accordance with still another embodiment of the invention a protective coating includes datolite concentrate of the following composition:

| | Percent by weight of the total concentrate |
|---|---|
| Boron anhydrite | 15 to 16 |
| Calcium oxide | 34 to 35 |
| Silicon oxide | 40 to 45 |
| Iron oxides | 3 to 4 |
| Aluminum oxide | 1.5 to 2.0 |
| Calcination losses | 8 to 10. |

Such composition makes it possible to obtain a coating which shows higher mechanical strength, as compared to the prior-art refractory coatings, after solidification and sintering thereof.

In accordance with still another embodiment of the invention a protective coating can be provided for permanent casting molds, comprising the following ingredients: fire clay; graphite; water glass; and water; wastes of chemical industry, such as catalyst wastes from the production of synthetic rubber; and a mineralizer selected from the group consisting of boron-containing materials taken singly or in combination, the mineralizer consisting of danburite concentrate, datolite concentrate, ascharite, boric acid, colemanite, pandermite, borocalcite, boronatrocalcite; said ingredients all being present in the following amounts:

| | Percent by weight of the total coating |
|---|---|
| Catalyst wastes from the production of synthetic rubber | 20 to 31 |
| Mineralizer, boron-containing material selected from the above-mentioned group | 2 to 10 |
| Fire clay | 2 to 3 |
| Graphite | 1 to 3 |
| Water glass | 2 to 3 |
| Water, | the balance |

The coating of the afore-cited composition exhibits high mechanical-and-physical characteristics rendering it especially suitable for use in protecting bottom molds which undergo severe mechanical and physical shocks during teeming of molten metal therein, as well as enabling the reduction of surface defects during ingot casting, and increasing the yield of end-use metal.

In pursuance of the above-mentioned object of the invention, the herein proposed refractory coating for permanent metal casting molds comprises catalyst wastes from the production of synthetic rubber of the following composition: $Al_2O_3$; $Cr_2O_3$; $SiO_2$; CaO; MgO; $Fe_2O_3$; and $K_2O$; said ingredients being present in the following amounts:

| | Percent by weight of the total catalyst waste material |
|---|---|
| $Al_2O_3$, | the base |
| $Cr_2O_3$ | from 13 to 15 |
| $SiO_2$ | from 6 to 9 |
| CaO | from 0.1 to 0.7 |
| MgO | from 0.06 to 0.2 |
| $Fe_2O_3$ | from 0.2 to 0.6 |
| $K_2O$ | from 0.5 to 0.7 |

This protective coating makes it possible to enhance labor productivity in the shops where the mold composition for casting is prepared, and increase production capacity of such shops by introducing simpler operating techniques for preparing the refractory mass through elimination of such operations as cleaning and washing of ingot molds.

As a particular embodiment of the present invention, the herein proposed coating for casting molds and cores includes an abrasive slurry as the alumina-containing component and has the following composition: abrasive slurry; soda ash; fire clay; graphite; water glass; and water; said ingredients being present in the following amounts:

| | Percent by weight of the total coating |
|---|---|
| Abrasive slurry | 38 to 48 |
| Soda ash | 1 to 5 |
| Fire clay | 2 to 5 |
| Graphite | 1 to 3 |
| Water glass | 2 to 4 |
| Water, | the balance |

The coating of the herein above described composition possesses improved adhesion properties and, therefore, effectively withstands, after being affixed to the mold working surface, the washing-off force created by a flow of molten metal, said coating being free from critical and expensive materials, and easy to produce.

Alternatively, the protective coating of the invention may include the slurry of the following composition: calcium oxide; silicon oxide; aluminum oxide; magnesium oxide; titanium dioxide; said ingredients being present in the following amounts:

| | Percent by weight of the total weight of slurry |
|---|---|
| Calcium oxide | from 8 to 10 |
| Silicon oxide | from 8 to 10 |
| Aluminum oxide | from 70 to 77 |
| Magnesium oxide | from 0.5 to 2 |
| Titanium dioxide | from 3 to 5 |
| Calcination losses | the balance. |

Such a composition makes it possible to obtain a protective coating, which, if applied to the mold working surface in a layer with a thickness thereof being controlled over the height of a casting mold, ensures directed crystallization of metal and reduces defects in the ingot macrostructure.

The following examples show typical ways of carrying out the aims of the invention. It is understood, of course, that these examples are merely illustrative, and the invention is not limited thereto.

In accordance with the invention, there has been developed a protective coating of the following composition: commercial-grade alumina; datolite concentrate; soda ash; fire clay; graphite; water glass; said ingredients being present in the following amounts:

| | Percent by weight of the total coating |
|---|---|
| Commercial-grade alumina | from 75 to 85 |
| Datolite concentrate | from 10 to 17 |
| Soda ash | from 5 to 8 |
| in excess of 100%: | |
| fire clay | from 4 to 10 |
| Graphite | from 5 to 10 |
| Water glass | from 5 to 8 |

This coating underwent a mill trial.

EXAMPLE

The materials contained in the coating are first ground and then passed through a 144-mesh/$cm^2$ screen, to be afterwards batched, mixed in dry state in a mixer, then mixed with water (80 to 90 percent by weight of the dry mass) until the suspension density equals 1.5 to 1.6 g/$cm^3$. Introduced into the obtained homogeneous suspension during stirring thereof is water glass with a density of 1.42 g/$cm^3$.

The ready-for-use suspension is then applied by spraying on the surfaces of ingot molds heated to a temperature of from 150° to 200° C. The thus prepared and applied coating dries fast, strongly adhering to the mold surface. The applied coating undergoes further forming as the initial flow of metal is poured in, which is due to the decomposition of datolite concentrate and soda under the effect of heat of the poured-in metal, and due to reactions between the resultant oxides.

The herein proposed coating makes it possible to carry out several casting cycles in metal molds with but single application of the coating to their surfaces.

The process of preparing the coating under mill conditions is similar to that described above.

Laboratory tests have been carried out to determine basic mechanical-and-physical properties of the herein proposed protective coating, and given herein below for the sake of comparison are those of the coating in accordance with U.S.S.R. Inventor's Certificate No 211,754 (see Table I).

Table I

| Characteristics | VALUES prior art | VALUES proposed |
|---|---|---|
| 1. Softening temperature, °C. | 1650 to 1710 | 1500 to 1800 |
| 2. Crushing strength, kg/$cm^2$ /after drying/ | 12.1 to 15.0 | 18.5 to 19.0 |
| 3. Crushing strength, kg/$cm^2$ | 13.7 to 16.2 | 17.0 to 50.0 |
| 4. Porosity, % | 2.1 to 2.4 | 0.48 to 0.68 |
| 5. Thermal stability, thermal cycles 20-1600-20° C. | 6.0 | 10.0 to 50.0 |

As may be seen from the above Table, the proposed coating features higher mechanical strength and thermal stability, as well as lower porosity.

Thus, the introduction of the datolite concentrate and soda ash instead of the vitreous component simplifies the production process, obviates the need of such processes as melting, sizing and grinding, as well as reduces the number of components present in the coating.

In addition, with BaO being excluded, said ingredients being present in the vitreous component, the health conditions of labor are improved and the cost for the coating is cut down.

The elimination of BaO from the composition of the herein proposed coating is predetermined by specific conditions of its service. The coating of the invention is used to afford protection to metal ingot molds employed under casting temperatures ranging from 1600° to 1640° C., whereas the coating of the U.S.S.R. Inventor's Certificate No 211,754 is intended for protecting molds and cores made of liquid self-curing mixtures used for cast-iron molds. The casting temperature of cast iron is within the range of from 1280° to 1350° C.

The introduction of BaO into the vitreous component was dictated by the necessity to provide better wettability of the coating applied to the metal mold surface and, consequently, its stronger adhesion to such mold surfaces.

The presence of the vitreous component in the coating composition stemmed from the necessity to fill the pores found in the cores made of liquid self-curing mixture with a purpose of compacting their structure, which in turn, is an important factor in obtaining castings free from burning-one and other faults.

The substitution of the vitreous component by the slurry and datolite concentrate in the coatings intended for protecting metal molds was a necessary step aimed to raise their softening temperature which is determined by their operating conditions (1600°-1640° C). The softening temperature of the coating should be 100° to 150° C. higher than actual temperature. This condition is not fulfilled with the vitreous component being added to the coating composition.

The substitution of the vitreous component by the datolite concentrate is not equivalent to the substitution thereof by slurry, as can be very well seen from the following chemical analyses, in percent by weight:

| Datolite concentrate | Slurry |
|---|---|
| $B_2O_3$ from 15 to 16 | — |
| CaO from 34 to 35 | 9.64 |
| $SiO_2$ from 40 to 45 | 9.43 |
| $FeO+Fe_2O_3$ from 3 to 4 | |
| $Al_2O_3$ from 1.5 to 2.0 | 73.67 |
| MgO | 1.19 |
| $TiO_2$ | 3.71 |
| Calcination losses from 8 to 10 | the balance. |

From the foregoing it follows that the base of slurry is $Al_2O_3$. Accordingly, the slurry was introduced into the coating as the refractory filler, whereas in the case of the aforesaid U.S.S.R. Inventor's Certificate the function of the refractory filler was carried out by commercial-grade alumina. The datolite concentrate functioned in this coating as a mineralizer. The presence of the datolite concentrate in the composition promotes better sintering of the coating during casting of molten metal into a mold, thereby endowing them with higher mechanical strength. This, in turn or makes it possible to carry out two, three casting cycles in the mold with a single coating application to its surface.

It is essential to develop alumina-free coating, the reason for this being the very high cost of commercial-grade alumina and the difficulty in its availability. Therefore, the replacement of alumina by abrasive slurry drastically cuts down the cost of such a coating.

There have been developed and prepared in the laboratory of the Ceramics Department still other compositions of the protective coating which have been subsequently tested under mill conditions, Table II

| Examples | I | II | III |
|---|---|---|---|
| Slurry | 78.5 | 81.0 | 79.5 |
| Soda ash | 3.0 | 6.5 | 9.0 |
| Fire clay | 8.0 | 4.0 | 5.5 |
| Graphite | 4.5 | 3.5 | 2.0 |
| Water glass | 6.0 | 5.0 | 4.0 |

The process of production, the techniques of application and adhesion of coatings to the mold working surface are similar in the case of Examples I, II and III.

The materials present in the coating are first ground and then passed through a 144-mesh/cm$^2$ screen, mixed in dry state in a mixer, then mixed with water to make a suspension (slip), having a density of from 1.45 to 1.6 g/cm$^3$, (the added water constitutes 80 to 90 percent by weight of the dry mix). Afterwards, water glass with a density of 1.4 g/cm$^3$ is introduced into the obtained suspension which is then applied by spraying to the surface of an ingot mold heated to a temperature of 150° to 200° C. The temperature within the aforesaid range permits fast drying of the coating and its adhesion to the mold working surfaces. The applied coating undergoes further forming in the process of casting due to the heat of the poured-in molten metal, said heat causing dissociation of the initial components introduced into the batch material, as well as reactions between the resultant active oxides.

The process of the coating production under mill conditions is similar to that described above. The proposed coating makes it possible to carry out several casting cycles (from 3 to 4 cycles) in metal molds with but a single application of the coating to their surfaces, prolong service life of casting molds by as much as 16 to 20%, increases the yield of use-end metal by 10 to 12% (the data presented is obtained during industrial tests).

Basic mechanical-and-physical characteristics of the proposed coating and those of the prior art have been determined under laboratory conditions, which are given below in Table III.

Table III

| Characteristics | Values | |
|---|---|---|
| | prior art | proposed |
| 1. Softening temperature, °C. | 1650 to 1710 | 1680 to 1710 |
| 2. Crushing strength, kg/cm$^2$ after drying | 12.1 to 15.0 | 15.3 to 17.5 |
| 3. Crushing strength, kg/cm$^2$ after calcination | 13.7 to 16.2 | 16.9 to 22.5 |

As can be seen from the above Table III, the proposed coating is characterized by higher strength and lower application losses under attrition loads, which is derived from the fact that the grains of slurry are smaller in size and more acute-angled in shape than those of alumina, hence their high reactivity with other components of the coating material and, consequently, higher mechanical strength.

Any alternations in or deviations from the permissible range of proportions of the coating components are inadmissable, and should it be otherwise, the operating performance of such a coating will be adversely affected (see Table III), namely: the mechanical strength thereof will decrease both in the dry- and calcined state, which, in turn, reduces service life of the coating and requires its application before each casting cycle. In addition, the coating losses will increase due to attrition at the moment the molds are stripped off the ingots, and the coating softening temperature will substantially decrease. Overall, the impairment of chemical-and-physical properties of the coating will result in a lower yield of the use-and metal due to the intrusion of alumo-silicate impurities off the coating into the steel being produced.

Table IV

| Ingredients | Composition, wt. % I | II |
|---|---|---|
| Abrasive slurry | 76.0 | 84.0 |
| Soda ash | 11.5 | 2.5 |
| Fire clay | 5.5 | 6.0 |
| Graphite | 2.5 | 4.5 |
| Water glass | 4.5 | 3.0 |
| Mechanical strength after drying, kg/cm$^2$ | 15.0 | 13.8 |
| Mechanical strength after calcination, kg/cm$^2$ | 17.2 | 15.9 |
| Softening temperature, °C. | 1620 | 1750 |

The substitution of the vitreous component by the soda ash, therefore, has brought about higher mechanical strength of the coating, which is due to higher reactivity of soda while interacting with a refractory filler (slurry), and simplified the process of the coating production by eliminating such operations as melting, sizing and grinding.

In addition, the exclusion of BaO present in the vitreous component, improves health conditions at work, and the introduction of slurry renders the protective coating more available, cheaper to produce and use.

There have been also proposed protective coatings which include such components as fire clay, graphite, water glass, water, and mineralizer. The coating also contains chemical wastes, namely, catalyst wastes from the production of synthetic rubber, the mineralizer being selected from the group consisting of boron-containing minerals: danburite concentrate, datolite concentrate, ascharite, boric acid, colemanite, pandermite, borocalcite, boronatrocalcite, said ingredients being present in the following amounts:

| | Percent by weight of the total coating |
|---|---|
| Catalyst wastes from the production of synthetic rubber | from 20 to 31 |
| Mineralizer, boron-containing material | from 2 to 10 |
| Fire clay | from 2 to 3 |
| Graphite | from 1 to 3 |
| Water glass | from 2 to 3 |
| Water | the balance |

The catalyst wastes from the production of synthetic rubber comprise the following ingredients, expressed in percent by weight of the waste material:

$Al_2O_3$, the base; $Cr_2O_3$, 13 to 15%; $SiO_2$, 6 to 9%; CaO 0.1 to 0.7%; MgO, 0.06 to 0.2%; $Fe_2O_3$, 0.2 to 0.6%; $K_2O$, 0.5 to 0.7%.

Refractoriness of the material based on the chemical wastes is 2000° C.

The composition of the refractory mass includes at least one of the aforesaid boron-containing materials.

The introduction of the boron-containing material assures improved adhesion properties of the refractory mass due to the presence of boron oxide ($B_2O_3$) in this material, which functions to provide better wettability of the coating applied to the mold surface and improve crystallization of the vitreous melt which is formed at the casting temperature of steel. In addition, boron oxide functions to step up sintering of the mass, thereby increasing its density.

Danburite concentrate is the product obtained in the process of danburite ore treatment by magnetic separation and flotation, made up of the following ingredients, expressed in percent by weight of the concentrate:

$SiO_2$, the base; $B_2O_3$, 20 to 21%; CaO, 30 to 30%; $Si_2O_3$, 1 to 2%; $Fe_2O_3$, 2 to 3%.

Datolite concentrate is the datolite ore-dressing product. Its chemical composition is as follows, expressed in percent by weight of the concentrate: $SiO_2$, the base; $B_2O_3$, 15 to 16%; CaO, 34 to 35%; FeO and $Fe_2O_3$, 3 to 4%; $Al_2O_3$, 1.5 to 2.0%.

Ascharite is the product obtained during treatment of borate ores and comprises the following ingredients, expressed in percent by weight of the product: $B_2O_3$, 19.07 to 40.88%; MgO, 3.51 to 44.6%; $Al_2O_3$, 0.18 to 3.78%; losses, the balance of up to 100%.

The ascharite composition being variable, it is, therefore, averaged out after pre-crushing and pre-grinding thereof.

Boric acid ($H_3BO_3$) can be replaced by boron-containing materials from which it is produced, such as colemanite, expressed as $Ca_2B_6O.5H_2O$; pandermite, expressed as $Ca_2B_6O_{11}.3H_2O$ borocalcite, expressed as $CaB_4O_7.6H_2O$; boronatrocalcite, expressed as $CaNaB_5O_9.6H_2O$.

Given herein below in Table V are preferable compositions of refractory coatings.

Table V

| Ingredients | Percent by weight of the coating mix No. 1 | mix No. 2 | mix No. 3 | mix No. 4 | mix No. 5 |
|---|---|---|---|---|---|
| 1. Catalyst wastes from the production of synthetic rubber | 29.6 | 23.0 | 26.5 | 20.3 | 30.4 |
| 2. Boric acid /or its substitutes such as colemanite, pandermite, borocalcite, boronatrocalcite | 3.7 | — | — | — | — |
| 3. Danburite concentrate | — | 9.7 | 3.3 | — | — |
| 4. Datolite concentrate | — | — | — | 8.7 | 2.5 |
| 5. Fire clay | 2.2 | 2.4 | 2.0 | 2.2 | 2.5 |
| 6. Graphite | 1.5 | 2.4 | 1.3 | 2.1 | 2.0 |
| 7. Water glass | 3.0 | 2.4 | 2.6 | 2.2 | 2.5 |
| 8. Water | the balance up to 100% | the balance up to 100% | the balance up to 100% | the balance up to 100% | the balance up to 100% |

The refractory mass for coatings is prepared in the following manner.

First, all the ingredients included in the composition are mixed in dry state. The obtained dry mixture is then mixed with water until the suspension density is 1.50 to 1.65 g/cm$^3$ and, finally, water glass with a density of 1.45 to 1.5 g/cm$^3$ is introduced into the mixture while it is stirred.

The ready-for-use suspension is thence applied by means of an injector to the mold working surface with a temperature thereof ranging from 150° to 200° C., which assures drying of the coating and its adhesion to the surfaces of casting molds.

Further on, as the first portion of molten metal is poured in, there takes place sintering or bonding together of grains of the components contained in the coating. Ultimate forming of the coating, however, is effected due to the fusion of boron-containing materials, which takes place under the action of heat off the molten metal with the formation of a glassy melt. In addition, the silica present in chemical wastes transforms under high temperatures into a vitreous component, thereby increasing the total amount of liquid phase which steps up to a great extent the sintering process and strengthens the coating.

Given below in Table VI are basic characteristics of the proposed refractory coatings.

Table VI

| | Characteristics | Data |
|---|---|---|
| 1. | Softening temperature, °C. | 1850 to 1950 |
| 2. | Wetting angle, degrees | 4 to 10 |
| 3. | Strength in dry state, kgf/cm$^2$ | 20.5 to 23.0 |
| 4. | Strength in backed state | 700 to 1000 |
| 5. | Attrition losses, % | 0.1 to 0.2 |
| 6. | Operating durability, number of casting cycles | 5 to 6 |

As can be seen from Table VI, the introduction of the chemical wastes and natural boron-containing materials into the coating composition enables the softening temperature of the coating to be increased due to high refractoriness of the wastes (2000°), as well as higher mechanical strength and longer service life of the coating due to its improved adhesion properties.

Moreover, the preparation of the refractory mass obviates the need for its pre-treatment, for example, crushing, grinding, and screening of its components, which simplifies the production process and reduces its cost.

Excellent mechanical-and-physical characteristics of the refractory mass render it especially suitable for application to the surfaces of bottom molds.

What is claimed is:

1. A protective coating for metal ingot molds, casting molds and cores, consisting of fire clay, graphite, water glass, water and a glassceramic component consisting of an alumina-containing material in an amount of not more than a half the weight of the total mixture and containing not less than 70 percent by weight of $Al_2O_3$, in alpha form, by weight of its chemical composition.

2. A protective coating for metal ingot molds, casting molds and cores, consisting of the following ingredients and amounts:

| | Percent by weight of the total coating material |
|---|---|
| Alumina-containing material having an $Al_2O_3$, in alpha form, content of less than 70 wt. % of its chemical composition | from 20 to 48 |
| Boron-containing material having a $B_2O_3$ content not less than 15 wt. % of its chemical composition selected | from 0 to 10 |

-continued

| | Percent by weight of the total coating material |
|---|---|
| from the group consisting of datolite concentrate, danburite concentrate, ascharite, boric acid, colemanite, pandermite, borocalcite, boronatrocalcite, and mixtures thereof | |
| Soda ash | from 0 to 5 |
| Fire clay | from 2 to 5 |
| Graphite | from 1 to 4 |
| Water glass | from 2 to 5 |
| Water | the balance |

3. A protective coating for ingot molds, casting molds and cores, consisting of the following materials and amounts:

| | Percent by weight of the total coating material |
|---|---|
| Commercial-grade alumina | from 35 to 40 |
| Datolite concentrate | from 5 to 7 |
| Soda ash | from 2 to 4 |
| Graphite | from 2.5 to 4 |
| Fire clay | from 2 to 4 |
| Water glass | from 2 to 5 |
| Water | the balance; |

wherein the datolite concentrate has the following composition:

| | Percent by weight of the total concentrate |
|---|---|
| Boron anhydrite | from 15 to 16 |
| Calcium oxide | from 34 to 35 |
| Silicon oxide | from 40 to 45 |
| Iron oxides | from 3 to 4 |
| Aluminum oxide | from 1.5 to 2.0 |
| Calcination losses | from 8 to 10 |

4. A protective coating of refractory material for permanent casting molds, consisting of the following ingredients and amounts:

| | Percent by weight of total coating material |
|---|---|
| Catalyst wastes from the production of synthetic rubber | from 20 to 31 |
| Boron-containing material selected from the group consisting of danburite concentrate, datolite concentrate, ascharite, boric acid, colemanite, pandermite, borocalcite, boronatrocalcite, and mixtures thereof | from 2 to 10 |
| Fire clay | from 2 to 3 |
| Graphite | from 1 to 3 |
| Water glass | from 2 to 3 |
| Water | the balance; |

wherein said catalyst wastes consists of the following ingredients and amounts:

| | Percent by weight of the total catalyst waste material |
|---|---|
| $Al_2O_3$ | the base |

-continued

| | Percent by weight of the total catalyst waste material |
|---|---|
| $Cr_2O_3$ | from 13 to 15 |
| $SiO_2$ | from 6 to 9 |
| CaO | from 0.1 to 0.7 |
| MgO | from 0.06 to 0.2 |
| $Fe_2O_3$ | from 0.2 to 0.6 |
| $K_2O$ | from 0.5 to 0.7 |

5. A protective coating for casting molds and cores, consisting of the following ingredients and amounts:

| | Percent by weight of the total coating material |
|---|---|
| Alumina-containing abrasive material | from 38 to 48 |

-continued

| | Percent by weight of the total coating material |
|---|---|
| Soda ash | from 1 to 5 |
| Fire clay | from 2 to 5 |
| Graphite | from 1 to 3 |
| Water glass | from 2 to 4 |
| Water | the balance; |

wherein the abrasive material consists of the following ingredients and amounts:

| | Percent by weight of the total material |
|---|---|
| Calcium oxide | from 8 to 10 |
| Silicon oxide | from 8 to 10 |
| Aluminum oxide | from 70 to 77 |
| Magnesium oxide | from 0.5 to 2 |
| Titanium dioxide | from 3 to 5 |
| Calcination losses | the balance. |

* * * * *